US011225403B2

(12) United States Patent
Stapensea

(10) Patent No.: US 11,225,403 B2
(45) Date of Patent: Jan. 18, 2022

(54) MODULAR PIT STRUCTURE FOR A LIFTING SYSTEM, SUCH LIFTING SYSTEM AND METHOD FOR BUILDING SUCH PIT STRUCTURE

(71) Applicant: Stertil B.V., Kootstertille (NL)

(72) Inventor: Jan Bernhard Stapensea, St. Annaparochie (NL)

(73) Assignee: Stertil B.V., Kootstertille (NL)

( * ) Notice: Subject to any disclaimer, the term of this patent is extended or adjusted under 35 U.S.C. 154(b) by 236 days.

(21) Appl. No.: 15/898,729

(22) Filed: Feb. 19, 2018

(65) Prior Publication Data

US 2019/0256333 A1 Aug. 22, 2019

(51) Int. Cl.

| | |
|---|---|
| ***B66F 7/28*** | (2006.01) |
| ***E04H 5/06*** | (2006.01) |
| ***B66F 7/16*** | (2006.01) |
| *B66F 7/06* | (2006.01) |

(52) U.S. Cl.
CPC ..... *B66F 7/28* (2013.01); *B66F 7/16* (2013.01); *E04H 5/06* (2013.01); *B66F 7/0666* (2013.01)

(58) Field of Classification Search
CPC ..... B66F 7/28; B66F 7/16; E04H 5/06
See application file for complete search history.

(56) References Cited

U.S. PATENT DOCUMENTS 2,564,289 A * 8/1951 Walker ..... B66F 7/16 187/203
3,111,196 A * 11/1963 Plassman ..... B66F 7/18 187/216
3,837,435 A * 9/1974 Pelouch ..... B66F 7/0625 187/211
4,685,837 A * 8/1987 Cicanese ..... E02D 17/08 405/272
4,961,293 A * 10/1990 House ..... B65D 88/76 52/21
5,259,482 A * 11/1993 Proulx ..... E04H 5/06 187/205
5,404,968 A * 4/1995 Fletcher ..... B66F 7/14 187/205
5,727,655 A * 3/1998 Pitman ..... B66F 7/0641 108/145
6,685,392 B1 * 2/2004 Wokas ..... B67D 7/78 141/59
6,939,081 B1 * 9/2005 Gropp ..... B60S 5/02 137/312
9,365,999 B1 * 6/2016 Jordan ..... E02D 27/50
(Continued)

FOREIGN PATENT DOCUMENTS

WO 2015108414 A1 7/2015

*Primary Examiner* — Michael A Riegelman
(74) *Attorney, Agent, or Firm* — The Webb Law Firm

(57) ABSTRACT

The present invention relates to a modular pit structure for an inground lifting system. The pit structure includes: a first end part; a second end part; at least one intermediate part, wherein the at least one intermediate part has a length, a width and a height; and a frame configured to be placed in an assembled pit structure. After assembling of a pit, the length of the intermediate part extends in a substantially horizontal direction between the first and second end parts and an interlock between adjacent parts of the pit structure extends in a substantially vertical direction.

17 Claims, 5 Drawing Sheets

(56) References Cited

U.S. PATENT DOCUMENTS

| | | | | |
|---|---|---|---|---|
| 2004/0149520 | A1* | 8/2004 | Taylor | B66F 7/20 187/203 |
| 2008/0224107 | A1* | 9/2008 | Polins | B66B 9/16 254/45 |
| 2009/0249714 | A1* | 10/2009 | Combs | E04B 1/34 52/190 |
| 2011/0099922 | A1* | 5/2011 | Barram | E04H 5/06 52/169.7 |
| 2012/0312386 | A1* | 12/2012 | Barker | B60S 5/02 137/15.01 |
| 2014/0161583 | A1* | 6/2014 | Luinge | B66F 7/28 414/800 |
| 2016/0332853 | A1* | 11/2016 | Fijnvandraat | B66F 7/16 |
| 2017/0029255 | A1* | 2/2017 | Kendall | B66F 7/28 |
| 2017/0088405 | A1* | 3/2017 | De Jong | B66F 3/46 |
| 2017/0233230 | A1* | 8/2017 | Kendall | B66F 7/28 187/215 |
| 2019/0248634 | A1* | 8/2019 | Stapensea | B66F 17/006 |
| 2019/0256333 | A1* | 8/2019 | Stapensea | B66F 7/16 |

* cited by examiner

MODULAR PIT STRUCTURE FOR A LIFTING SYSTEM, SUCH LIFTING SYSTEM AND METHOD FOR BUILDING SUCH PIT STRUCTURE

FIELD OF THE INVENTION

The invention relates to a pit structure for a lifting system capable of lifting a vehicle such as passenger cars, trucks, busses and other vehicles. The invention also relates to a lifting system for lifting a vehicle that comprises such modular pit structure. The invention further also relates to a method for building such pit structure.

BACKGROUND

WO 2015/108414 discloses an inground lifting system for lifting a vehicle and a method for configuring an inground lifting system and which is incorporated herein by reference.

Conventional pit structures require substantial manufacturing, transportation and handling costs. Installing a conventional pit structure is also time-consuming.

An object of the present invention is to obviate or at least reduce the aforementioned problems associated with conventional lifting devices.

SUMMARY OF THE INVENTION

This object is achieved with the modular pit structure for a lifting system according to the present invention.

In one of the preferred embodiments of the invention the pit structure comprises:

- a first end part;
- a second end part;
- at least one intermediate part, wherein the at least one intermediate part has a length, a width, and a height; and
- a frame configured to be placed in an assembled pit structure, wherein after assembling of a pit the length of the intermediate part extends in a substantially horizontal direction between the first and second end parts and an interlock between adjacent parts of the pit structure extends in a substantially vertical direction.

The modular pit structure is advantageously applied to so-called inground lifting systems. Such lifting system preferably comprises a first lifting device with a stationary position that is used for lifting the front, or alternatively the rear, of the vehicle to be lifted. The inground lifting system further comprises one, two, three or more movable lifting devices for lifting the other part(s) of the vehicle. These movable lifting devices are provided in the pit structure that enables a translational movement of the movable lifting devices. In use, this movement of the movable lifting devices is substantially in a lengthwise direction of the vehicle to be lifted. By enabling such translational movement of one or more of the multiple lifting devices a broad range of vehicle dimensions and vehicle types can be dealt with.

By providing a first end part and a second end part of the pit structure, some of the basic components of the modular pit structure are provided. It will be understood that the first end part and the second end part can be similar or can even be exactly the same. The pit structure further comprises at least one intermediate part that after assembly is positioned between the first end part and the second end part with an interlock connecting adjacent parts of the pit structure. For small pit structures one intermediate part may be sufficient, while for larger pit structures multiple intermediate parts, such as 2, 3, 4, 5, 6, 7, 8 etc., are provided between the first end part and second end part. Depending on the desired pit structure dimensions the number of intermediate parts can be adjusted accordingly. The modular pit structure further comprises a frame that is configured to be placed in an assembled pit structure with the end parts and intermediate parts.

The intermediate parts of the modular pit structure have a length, a width and a height. Preferably, the length and width are predefined. In an installed state of the pit structure, after assembly of the components of the modular pit structure, the length of the intermediate part extends in a substantially horizontal direction between the first and second end parts and the height of the intermediate part extends in a substantially vertical direction. This provides modular parts that can be manufactured, transported and handled relatively easily. This renders manufacturing of a pit structure less time consuming. Furthermore, the use of modular parts enables installing a pit structure accurately.

In addition to the preferably predetermined length and width of the intermediate parts these parts are preferably also provided with a standardized height. This preferably standardized height of the modular intermediate part determines the depth of the installed pit. It will be understood that it would be possible to define several standardized depths and/or to define custom made depths for pit structures. Furthermore, the intermediate parts are optionally provided in different types with different sizes, more specifically different lengths.

In one of the presently preferred embodiments the first predetermined length of the intermediate part is about 3 feet (corresponding to about 914 mm) and a second predetermined length is about 4 feet (corresponding to about 1219 mm). This enables providing a pit structure having a pit length extending over a distance between 10-17 feet with steps of 1 feet. It will be understood that other dimensions could also be envisaged in accordance with the present invention. Also, it is possible to define more different intermediate parts with different modular dimensions.

In a further embodiment of the invention, the intermediate parts have a U-shape. These U-shape modular intermediate parts provide an effective modular part for the modular pit structure. Such U-shaped intermediate parts can be installed effectively and provide an accurate pit structure that can be installed in accordance with the desired specifications. As a further advantage the U-shaped modular parts provide two side walls (segments) and a pit floor (segment) in a single modular part.

In a preferred embodiment of the invention the connection between adjacent parts of the pit structure comprises a so-called form closure to which is also referred to as an embodiment of an interlock. This interlock is preferably constructed as a tongue and groove connection with a suitable sealant to make a substantially watertight connection between the parts. This closure or interlock further improves the stability and accuracy of the assembled pit structure with the modular elements according to the invention.

In one of the preferred embodiments of the invention the pit structure further comprises a cover. The cover, more specifically a pit cover, provides a safety measure and covers a substantial part of the pit during the operation. The pit cover may comprise plates and/or hinged cover elements that are optionally connected to a movable lifting device such that the pit substantially remains covered during translation movement of the movable lifting device.

In one of the preferred embodiments of the invention the intermediate parts comprise connecting elements that are configured for connecting the pit structure with a lifting system or lifting device of such system. Preferably, the connecting elements are used in combination with a cover or pit cover.

In a preferred embodiment the pit structure further comprises a number of anchors. The frame is positioned with the aid of the anchors. Optionally, filling plates are used to further improve the positioning of the frame relative to the modular parts of the pit structure. After installation of the frame the recess around the frame and frame parts is preferably filled with concrete that will form a structural and level connection to the workshop floor.

Further embodiments of the invention relate to a lifting system that comprises a modular pit structure in one of the embodiments thereof. Preferably, the lifting system comprises a lifting device and more specifically a vehicle lift.

The invention also relates to a method for building a pit structure, with the method comprising the steps of providing a modular pit structure in an embodiment of the invention, installing and assembling the pit structure, placing the frame in the assembled pit structure, and installing a lifting device in the pit structure.

Preferably, in further embodiments of the method according to the invention, the method comprises the step of calculating a number of intermediate parts. This enables providing a specific pit structure composed of preferably standardized intermediate parts. Furthermore, alternatively or in addition thereto, the method also comprises the step of installing a cover and/or providing a seal between adjacent parts and/or filling a recess around the frame to make a structural and level connection to a workshop floor.

BRIEF DESCRIPTION OF THE DRAWINGS

Exemplary embodiments of a lifting system and/or the method according to the present invention are described here below on the basis of a non-limitative exemplary embodiment therefor that is shown in the accompanying drawings, wherein.

DETAILED DESCRIPTION

The following description is merely exemplary in nature and is in no way intended to limit the invention, its application, or uses. While the disclosure is described as having exemplary attributes and applications, the present disclosure can be further modified. This application is therefore intended to cover any variations, uses, or adaptations of the disclosure using its general principles. Further, this application is intended to cover such departures from the present disclosure as come within known or customary practice of those skilled in the art to which this disclosure pertains and which fall within the limits of the appended claims. Accordingly, the following description of certain embodiments and examples should be considered merely exemplary and not in any way limiting.

The lift control system of the present invention is suitable for use with lifting systems comprising any number of lifting devices that require height control columns, including systems having one, two, four or another number of lifting systems. The lifting systems may achieve lifting and lowering capability by any means known to those of skill in the art, including hydraulically, electrically, mechanically, and electromechanically. Lifting systems compatible with the present lift control system may involve wired and/or wireless communication. With reference to the figures, like element numbers refer to the same element between drawings.

Figure 1A:
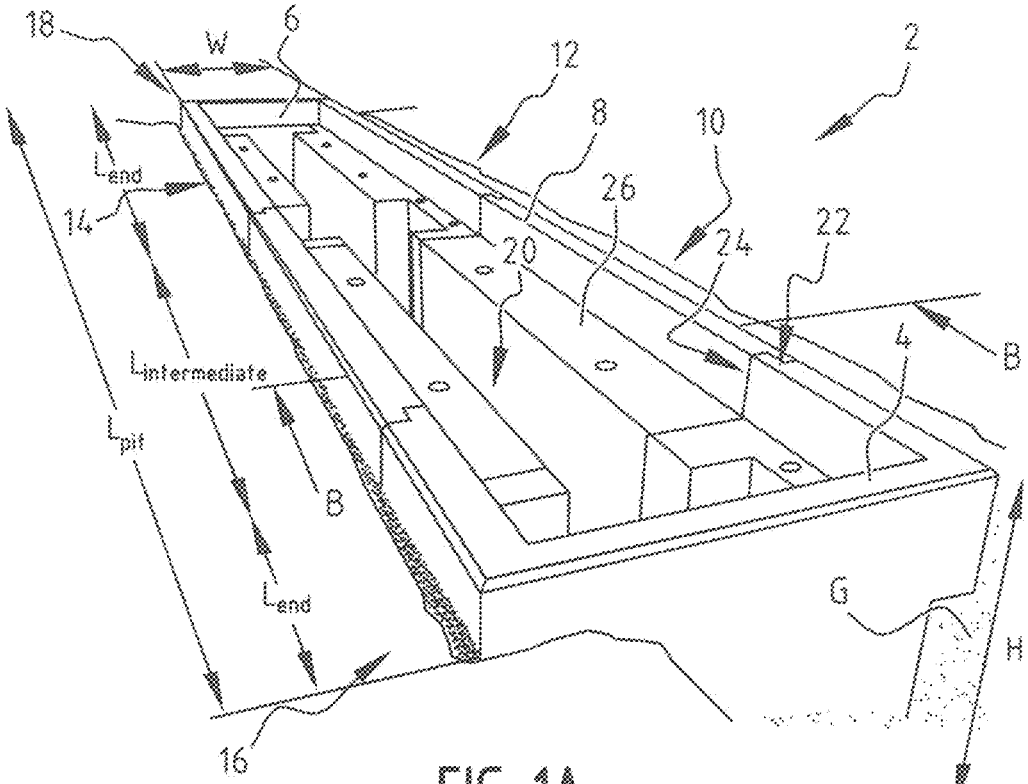
FIGS. 1A and 1B show a modular pit structure in an embodiment of the invention.

Pit structure 2 (FIG. 1A,B) in ground structure G comprises first end part 4 and second end part 6, and also intermediate parts 8 which abut with one another and together extend along a horizontal plane. In the illustrated embodiment intermediate part 8 is provided with a U-shape 10. Pit structure 2 further comprises first side 12, second side 14 and bottom 20. Adjacent intermediate parts 8 are connected with form closure or interlock 22. In the illustrated embodiment interlock 22 comprises tongue and groove elements. In the illustrated embodiment joint 24 is provided with a sealant. Edge 26 is provided to carry a frame. Pit structure 2 is provided with pit length $L_{pit}$, width W and height H. Pit length $L_{pit}$ is the sum of the lengths of the modular end parts 4,6 $L_{end}$ and intermediate part(s) 8 $L_{intermediate}$.

Figure 1B:
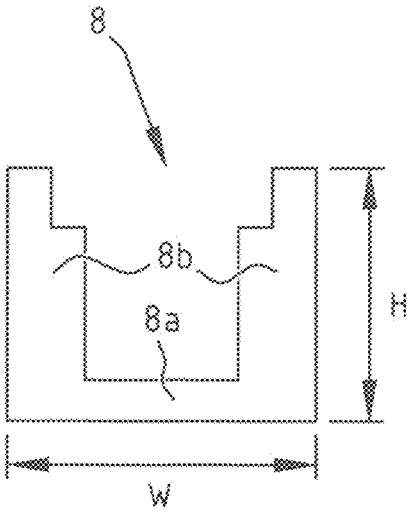
Figure 2:
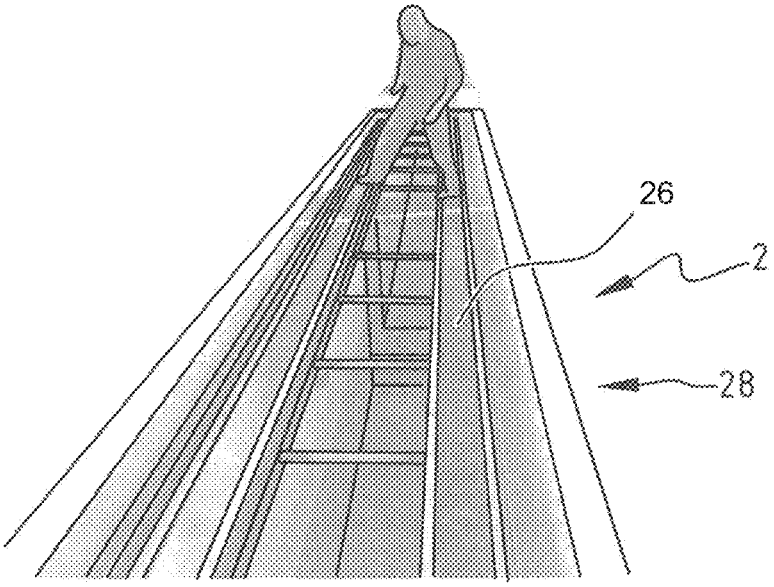
FIG. 2 shows the pit structure of FIG. 1 with an additional frame.
Figure 3:
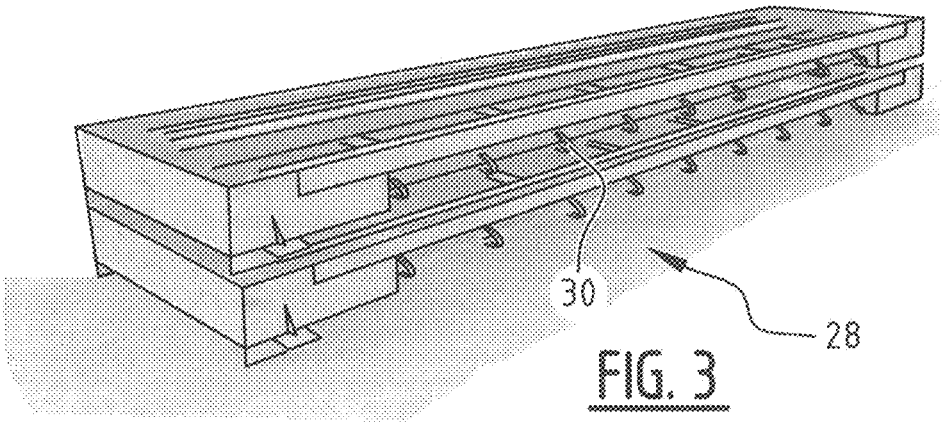
FIG. 3 shows frames that are stacked for transport.

Frame 28 (FIG. 2) is provided in pit structure 2 and carried by edge 26 thereof creating a recess 27 around the frame 28. Frames 28 (FIG. 3) and U-shaped intermediate parts 8 (FIG. 1B) are relatively easily transported to the desired location. Intermediate parts 8 have bottom 8*a*, and two side walls 8*b*.

Frame 28 (FIG. 3) is provided with anchors 30 to connect frame 28 to intermediate parts 8 and/or end parts 4, 6. Lifting structure 32 can be provided in pit structure 2.

In the illustrated embodiment (FIG. 4A) lifting system 32 comprises stationary piston lift 34 in combination with movable piston type lifting device 36. System 32 is provided with carrier 38 for movable lifting device 36. Carrier 38 is provided with cover plates 40, 42 on opposite sides thereof. Additional cover plates 44, 46 are provided. It will be understood that the actually used number of cover plates can be chosen in view of the pit structure dimensions. In the illustrated embodiment cover plate 40 may move underneath intermediate cover plate 44. Both cover plates 40, 44 may move underneath cover plate 46 and, optionally, the stack or set of cover plates 40, 44, 46 may move underneath top plate 48 of spacer module 50. In the illustrated embodiments spacer module 50 determines the distance between stationary lifting device 34 and the minimal distance to movable lifting device 36. Similarly, cover plate 42 may move underneath top plate 52 on the opposite side of carrier 38.

Figure 4A:
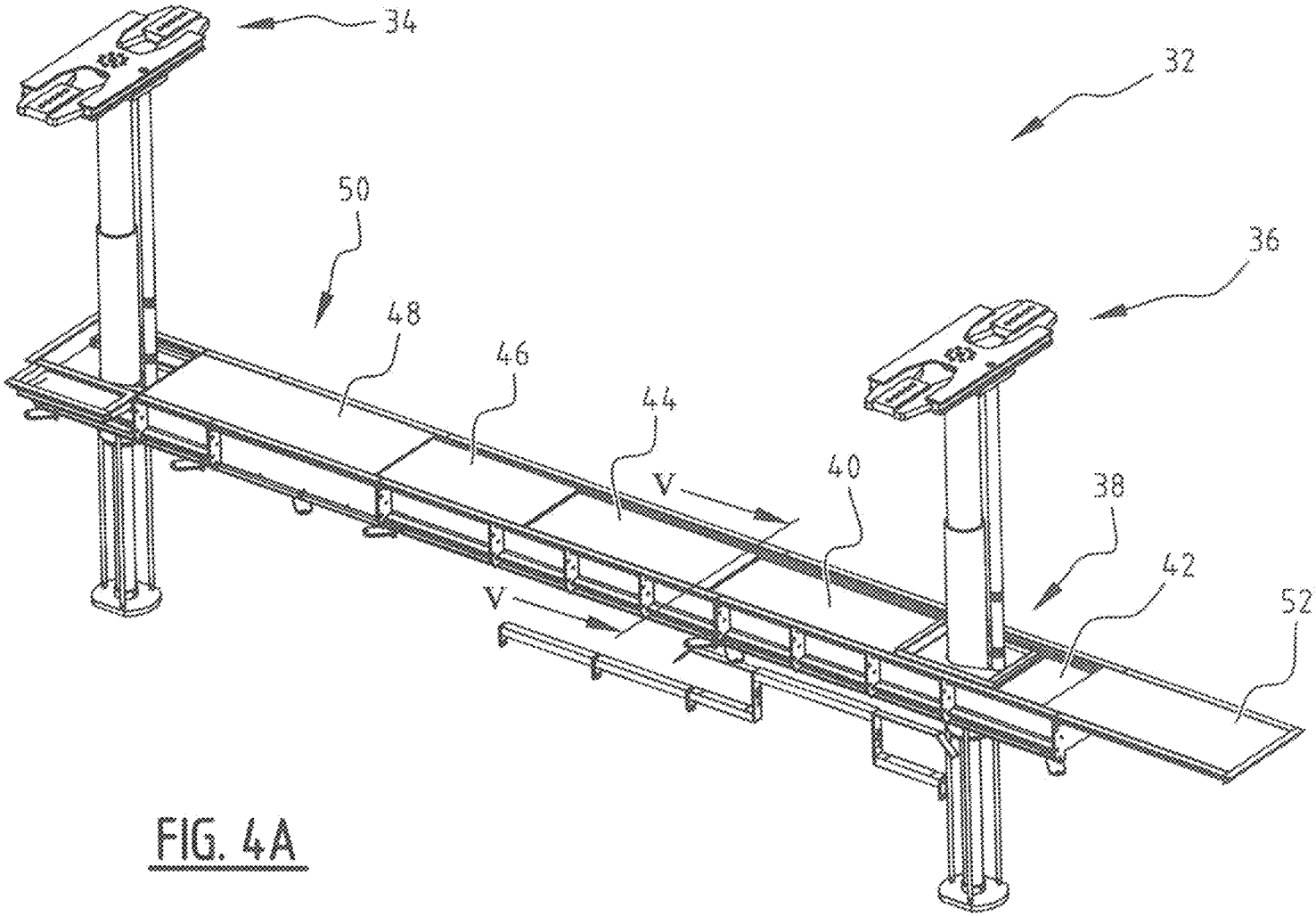
FIG. 4A shows a lifting system that can be positioned in the pit structure with lifting devices of a piston type.
Figure 4B:
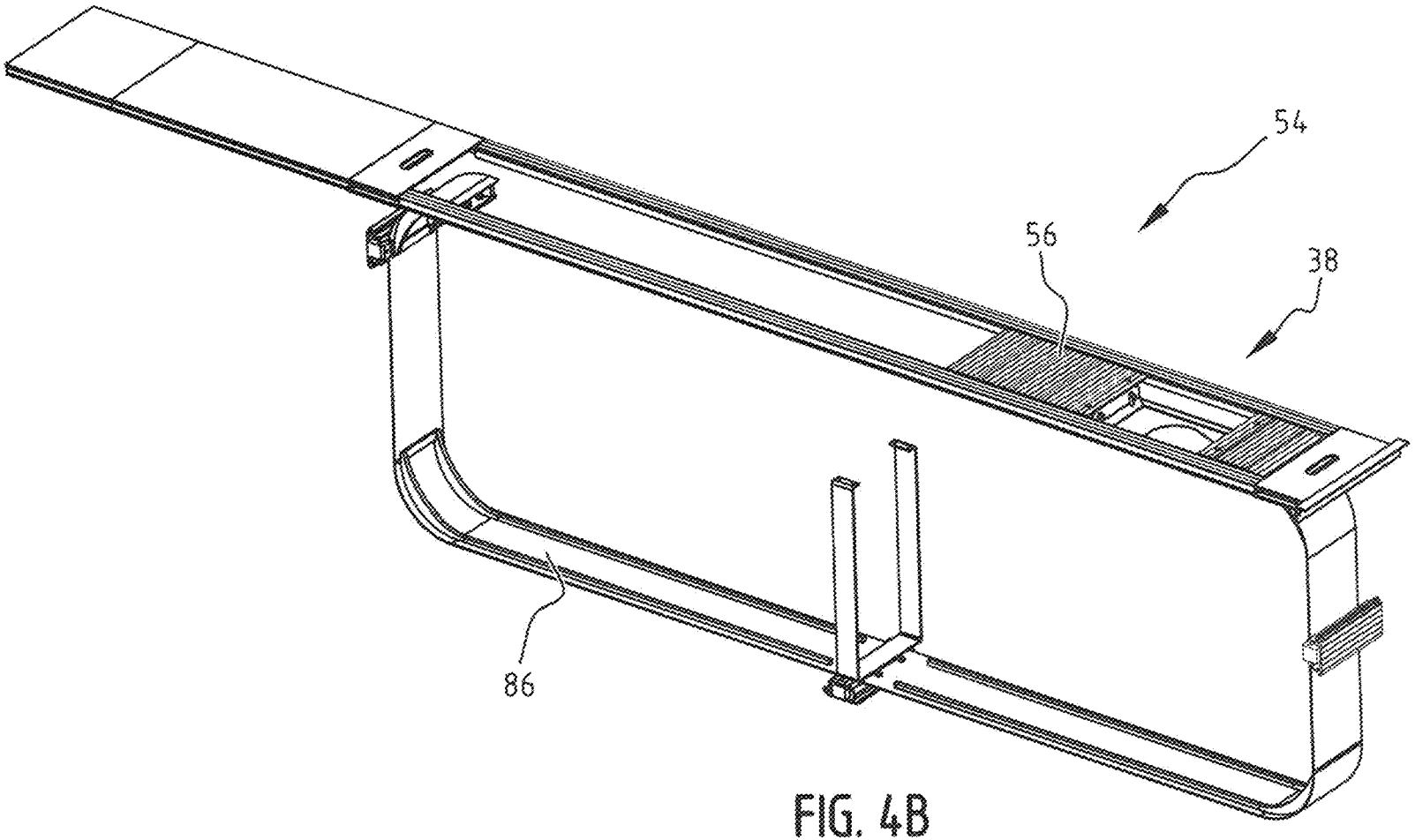
FIG. 4B shows a cover for the pit structure.

Alternatively, a rolling cover embodiment 54 (FIG. 4B) is provided as an alternative to cover plate embodiment 32 (FIG. 4A). Rolling cover embodiment 54 comprises rolling cover 56 that is preferably also connected to the opposite sides of carrier 38.

Figure 5:
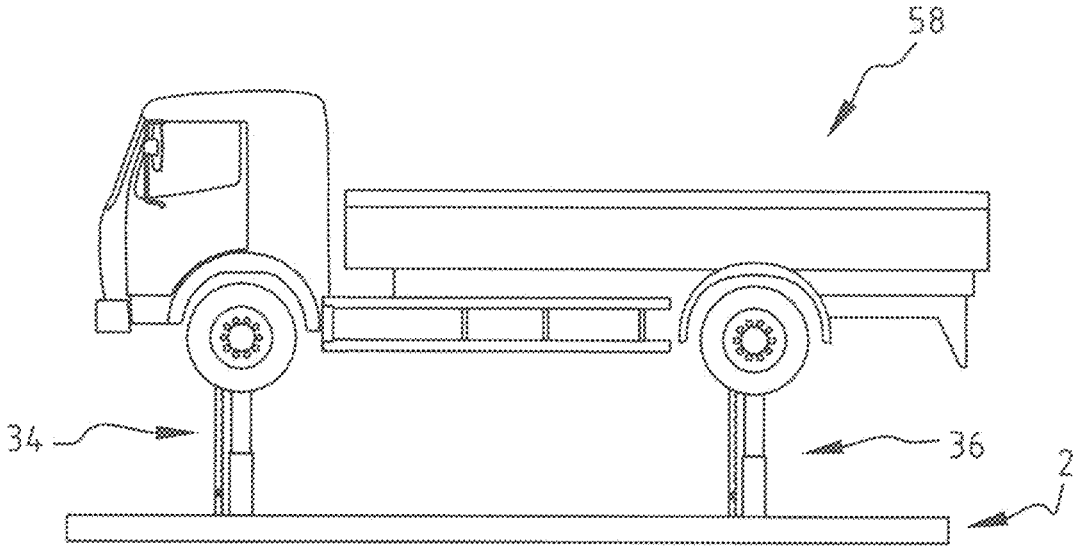
FIG. 5 shows the lifting system when lifting a vehicle.
Figure 6:
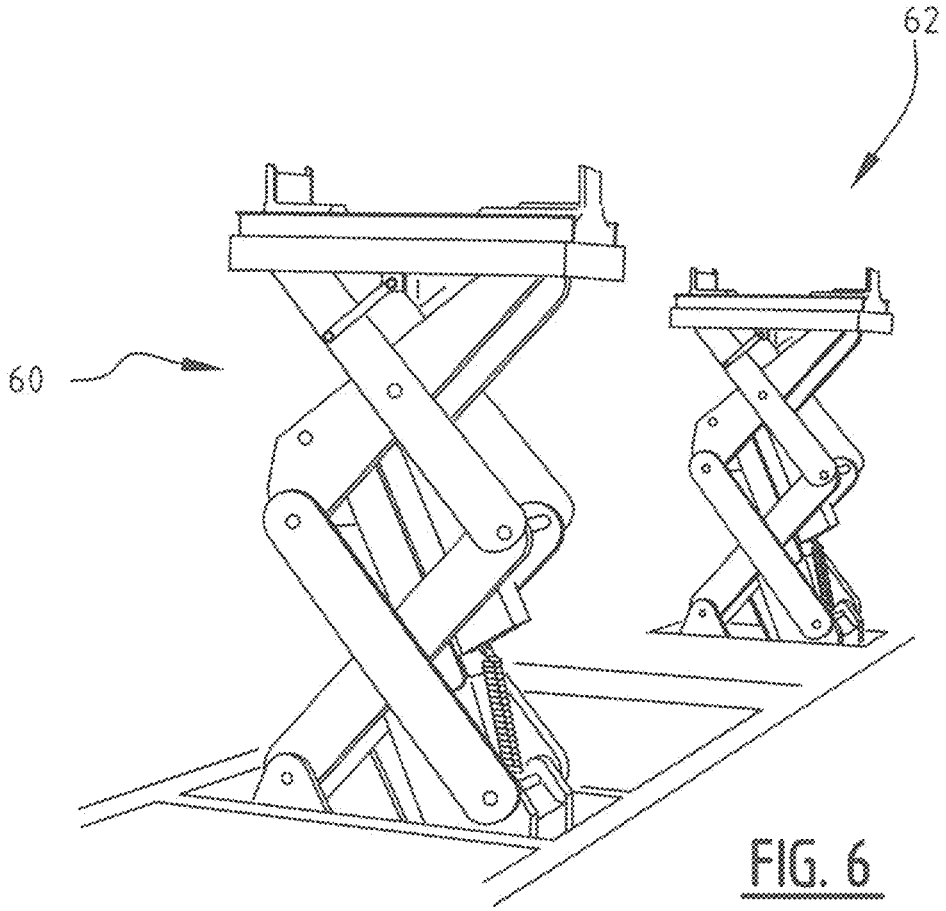
FIG. 6 shows an alternative lifting system of the scissor type.

In an embodiment pit structure 2 is provided with lifting devices 34, 36 (FIG. 5). In the illustrated embodiment stationary lifting device 34 lifts the front side of vehicle 58. It will be understood that alternatively also movable lifting device 36 may lift vehicle 58.

In a different embodiment of the invention, piston type lifting devices 34, 36 are replaced by scissor type lifting devices 60, 62. It will be understood that this type of lifting device can also be applied to the different embodiments of the illustrated piston type configurations.

Manufacturing pit structure 2 preferably starts with calculating the desired dimensions and the number of intermediate parts 8. After manufacturing the modular elements 4, 6, 8, and preferably also frame 28, the elements are transported to the desired location. After preparing the modular element, each element is installed adjacent to other elements and connected to adjacent elements. After positioning modular elements 4, 6, 8, frame 28 is positioned relative to pit structure 2. During assembly a seal is provided between adjacent parts and a recess around the frame is filled with concrete to make a structural and level connection to a workshop floor. Lifting devices such as piston type lifting devices 34, 36 and/or scissor type lifting devices 60, 62 are installed. Preferably, a cover is positioned relative to pit structure 2, such as the cover plate embodiment of FIG. 4A or the rolling cover embodiment of FIG. 4B.

The present invention is by no means limited to the above described preferred embodiments. The rights sought are defined by the following claims within the scope of which many modifications can be envisaged.

What is claimed is:

1. A modular pit structure for an inground lifting system, the pit structure comprising:

a first end part;

a second end part;

at least one intermediate part, wherein the at least one intermediate part has a length, a width and a height;

wherein the parts abut to form the pit structure and wherein the parts define a recess around and within the pit structure;

a frame placed in the pit structure, wherein the recess of the pit structure has an edge which carries the frame and wherein the recess is filled with concrete to form a structural and level connection to a workshop floor, and wherein after assembling of the pit structure the length of the intermediate part extends in a horizontal direction between the first and second end parts and an interlock between adjacent parts of the first end part, the second end part, and the at least one intermediate part of the pit structure extend in a vertical direction.

2. The modular pit structure of claim 1, wherein each of the at least one intermediate part has a first predetermined length.

3. The modular pit structure of claim 2, wherein each of the at least one intermediate part has a second predetermined length.

4. The modular pit structure of claim 3, wherein the first predetermined length is 3 ft (914 mm).

5. The modular pit structure of claim 4, wherein the second predetermined length is 4 ft (1219 mm).

6. The modular pit structure of claim 2, wherein each of the at least one intermediate part has a U-shape.

7. The modular pit structure of claim 6, wherein a connection between adjacent parts of the first end part, the second end part, and the at least one intermediate part of the pit structure comprises a form closure.

8. The modular pit structure of claim 1, wherein each of the at least one intermediate part has a U-shape.

9. The modular pit structure of claim 1, wherein a connection between adjacent parts of the first end part, the second end part, and the at least one intermediate part of the pit structure comprises a form closure.

10. The modular pit structure of claim 1, further comprising a cover.

11. The modular pit structure of claim 10, wherein each of the at least one intermediate part comprises connecting elements configured for connecting the pit structure with a lifting device.

12. The modular pit structure of claim 1, wherein each of the at least one intermediate part comprises connecting elements configured for connecting the pit structure with a lifting device.

13. The modular pit structure of claim 1, wherein the frame comprises a number of anchors.

14. The modular pit structure of claim 1, further comprising a number of cover plates.

15. The modular pit structure of claim 1, wherein the first end part, the second end part, and each of the at least one intermediate part together extend along a horizontal plane.

16. A lifting system comprising a modular pit structure and a lifting device, the pit structure comprising:

a first end part;

a second end part;

at least one intermediate part;

wherein the pails abut to form the pit structure and wherein the pans define a recess around and within the pit structure;

a frame placed in the pit structure, wherein the recess of the pit structure has an edge which carries the frame and wherein the recess is filled with concrete to form a structural and level connection to a workshop floor; and wherein the at least one intermediate part has a length, a width and a height, wherein after assembling of the pit structure the length of the at least one intermediate part extends in a horizontal direction between the first and second end parts and an interlock between adjacent parts of the pit structure extends in a vertical direction.

17. The lifting system of claim 16, wherein the lifting device comprises a vehicle lift.

* * * * *